US007119751B2

(12) United States Patent
Li et al.

(10) Patent No.: US 7,119,751 B2
(45) Date of Patent: Oct. 10, 2006

(54) DUAL-LAYER PLANAR ANTENNA

(75) Inventors: Qian Li, Ann Arbor, MI (US); Wladimiro Villarroel, Worthington, OH (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 49 days.

(21) Appl. No.: 11/077,609

(22) Filed: Mar. 11, 2005

(65) Prior Publication Data

US 2006/0202898 A1 Sep. 14, 2006

(51) Int. Cl.
*H01Q 1/32* (2006.01)

(52) U.S. Cl. ..... 343/713; 343/712

(58) Field of Classification Search ..... 343/711, 343/712, 713, 714, 715, 702, 700 MS
See application file for complete search history.

(56) References Cited

U.S. PATENT DOCUMENTS

| | | | | |
|---|---|---|---|---|
| 5,194,876 | A | 3/1993 | Schnetzer et al. | |
| 5,355,144 | A | 10/1994 | Walton et al. | |
| 5,565,875 | A | 10/1996 | Buralli et al. | |
| 5,646,637 | A | 7/1997 | Miller | |
| 5,748,153 | A | 5/1998 | McKinzie, III et al. | |
| 5,872,542 | A | 2/1999 | Simons et al. | |
| 5,898,405 | A | 4/1999 | Iwasaki | |
| 5,905,471 | A | 5/1999 | Biebl et al. | |
| 6,011,518 | A * | 1/2000 | Yamagishi et al. | 343/713 |
| 6,097,345 | A | 8/2000 | Walton | |
| 6,188,368 | B1 | 2/2001 | Koriyama et al. | |
| 6,201,504 | B1 * | 3/2001 | Aminzadeh et al. | 343/713 |
| 6,259,407 | B1 | 7/2001 | Tran | |
| 6,329,950 | B1 | 12/2001 | Harrell et al. | |
| 6,417,811 | B1 | 7/2002 | Adrian | |
| 6,545,647 | B1 | 4/2003 | Sievenpiper et al. | |
| 6,661,386 | B1 | 12/2003 | Petros et al. | |
| 6,853,339 | B1 * | 2/2005 | Sievenpiper et al. | 343/713 |

FOREIGN PATENT DOCUMENTS

| | | |
|---|---|---|
| EP | 0 355 898 B1 | 3/1989 |
| EP | 1 088 365 B1 | 6/1999 |

* cited by examiner

*Primary Examiner*—Shih-Chao Chen
*Assistant Examiner*—Minh Dieu A
(74) *Attorney, Agent, or Firm*—Howard & Howard Attorneys, P.C.

(57) ABSTRACT

An antenna for receiving an RF signal from a satellite is preferably integrated with a window of a vehicle. The window preferably includes a first nonconductive pane and a second nonconductive pane laminated together with a PVB adhesive layer. A first conductive layer is disposed on one of the surfaces of the nonconductive panes and a second conductive layer is disposed on another of the surfaces of the nonconductive panes. The second conductive layer includes a main slot extending thereinto. The main slot defines a feed line region and ground plane regions. The second conductive layer also includes stub slots extending into the ground plane regions for antenna impedance matching and providing the antenna with a circular polarization.

43 Claims, 9 Drawing Sheets

DUAL-LAYER PLANAR ANTENNA

BACKGROUND OF THE INVENTION

1. Field of the Invention

The subject invention relates to an antenna for receiving a circularly polarized radio frequency (RF) signal from a satellite.

2. Description of the Prior Art

Vehicles have long implemented glass to enclose a cabin of the vehicle while still allowing visibility for the driver of the vehicle. Automotive glass is typically either a tempered (or toughened) glass or a laminated glass which is produced by bonding two or more panes of glass together with an adhesive interlayer. The interlayer keeps the panes of glass together even when the glass is broken.

Recently, antennas have been integrated with the glass of the vehicle. This integration helps improve the aerodynamic performance of the vehicle as well to help provide the vehicle with an aesthetically-pleasing, streamlined appearance. Integration of antennas for receiving linearly polarized RF signals, such as those generated by AM/FM terrestrial broadcast stations, has been the principal focus of the industry. However, that focus is shifting to integrating antennas for receiving RF signals from Satellite Digital Audio Radio Service (SDARS) providers. SDARS providers use satellites to broadcast RF signals, particularly circularly polarized RF signals, back to Earth.

Various glass-integrated antennas for receiving RF signals are known in the art. Examples of such antennas are disclosed in the U.S. Pat. No. 5,355,144 (the '144 patent) to Walton et al. and U.S. Pat. No. 6,097,345 (the '345 patent) to Walton.

The '144 patent discloses an antenna integrated with a window of a vehicle. The vehicle includes a metal frame having an edge defining an aperture. The edge of the metal frame is electrically conductive and supports the window. The window includes two panes of glass sandwiching an adhesive interlayer. An electrically conductive film is bonded to a surface of one of the panes of glass and defines a slot between the film and the edge. A conductive layer is disposed on another of the surfaces of the panes of glass. A center conductor of an unbalanced transmission line is connected to the conductive layer and a shield of the unbalanced transmission line is connected to the metal frame. The conductive layer acts as a feed line to electromagnetically couple center conductor to the electrically conductive film. The antenna of the '144 patent is not configured to allow reception of circularly polarized RF signals. Furthermore, the antenna of the '144 patent contains no provisions for matching an impedance of the antenna to an impedance of the unbalanced transmission line.

The '345 patent discloses an antenna integrated with a window of a vehicle. The window is supported by a metal frame of the vehicle. The window includes two panes of glass sandwiching an adhesive interlayer. In one embodiment, a conductive layer is disposed on one of the surfaces of the panes of glass. The conductive layer defines a slot having two slot legs with resonance on two frequency bands. A feed line is disposed on another of the surfaces of the panes of glass. A center conductor of an unbalanced transmission line is electrically connected to the feed line. The feed line then acts as a capacitive coupling to the conductive layer. A shield of the unbalanced transmission line is electrically connected to the metal frame. The antenna of the '345 patent is not configured to allow reception of circularly polarized RF signals. Furthermore, the antenna of the '345 patent contains no provisions for matching an impedance of the antenna to an impedance of the unbalanced transmission line.

SUMMARY OF THE INVENTION AND ADVANTAGES

The subject invention provides an antenna including a first conductive layer and a second conductive layer. The second conductive layer is spaced from and substantially parallel to and overlapping the first conductive layer. The second conductive layer has a main slot extending thereinto to define a feed line region. The feed line region divides the second conductive layer into a first ground plane region and a second ground plane region. A conductive segment electrically connects the first ground plane region to the second ground plane region. The second conductive layer also defines a first stub slot extending from the main slot into the first ground plane region and a second stub slot extending from the main slot into the second ground plane region.

The subject invention also provides a window integrating the antenna described above. The window includes a first nonconductive pane having an outside surface and an inner surface. A second nonconductive pane is disposed generally parallel to and spaced from the first nonconductive pane and has an outer surface and an inside surface. The first conductive layer of the antenna is disposed on one of the surfaces and the second conductive layer is disposed on another of the surfaces.

The antenna combines ground plane and feed line regions into a single conductive layer. This combination negates the need for a separate feed line and ground plane in separate conductive layers. Furthermore, the stub slots alter the impedance of the antenna to match that of an unbalanced transmission line to be electrically connected to the antenna. Also, the angle of the stub slots with respect to the main slot may be configured to give the antenna desired polarization characteristics.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
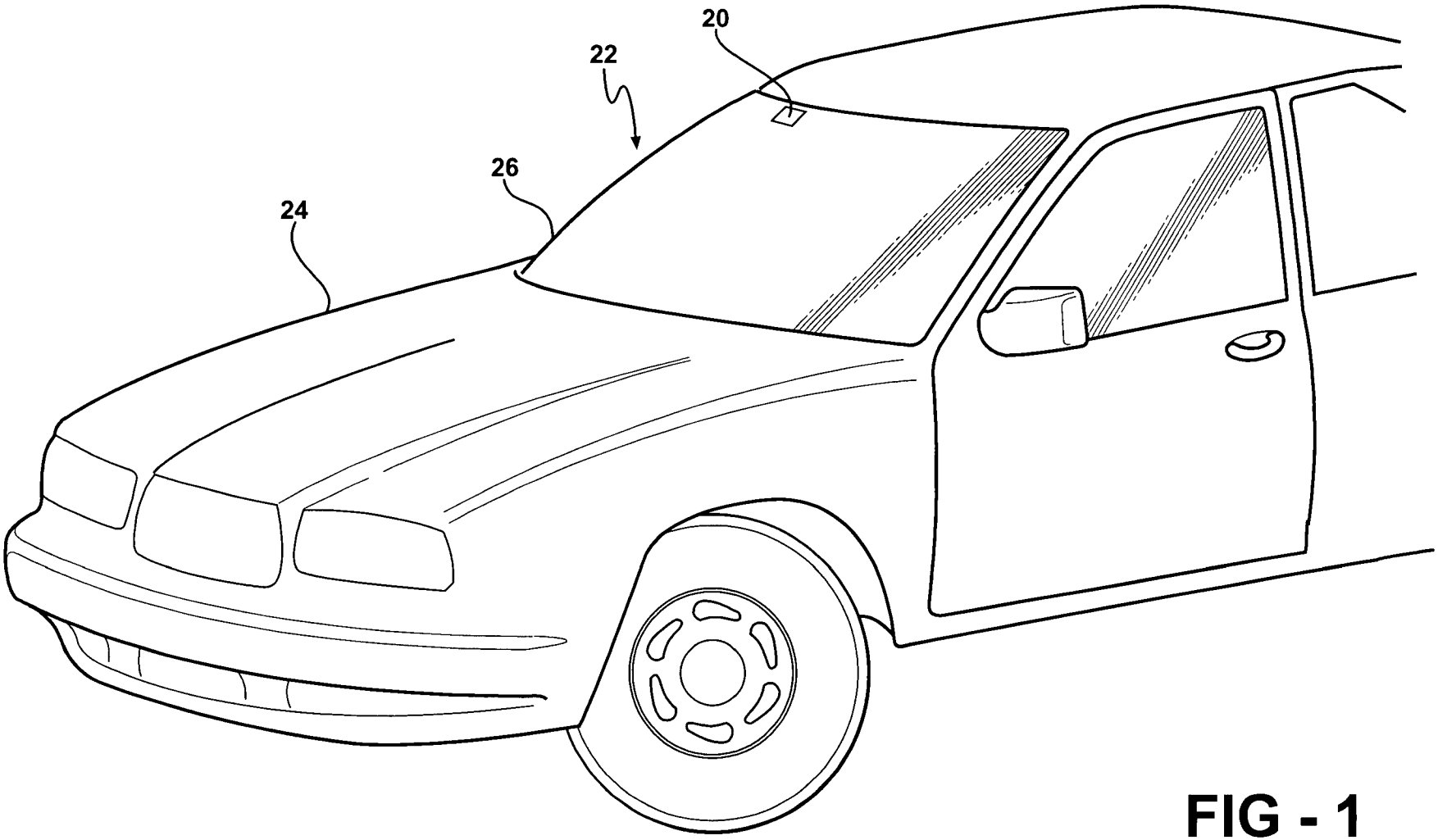
FIG. 1 is a perspective view of a vehicle with an antenna integrated with a windshield of the vehicle.

Referring to the Figures, wherein like numerals indicate corresponding parts throughout the several views, an antenna is shown generally at 20 in FIG. 1. In the preferred embodiment, the antenna 20 is utilized to receive a circularly polarized radio frequency (RF) signal from a satellite. Specifically, the antenna 20 of the preferred embodiment may receive a circularly polarized RF signal produced by a Satellite Digital Audio Radio Service (SDARS) provider, such as XM® Satellite Radio or SIRIUS® Satellite Radio. However, those skilled in the art realize that the antenna 20 may also be used to transmit the circularly polarized RF signal. Furthermore, the antenna 20 may be alternately configured to transmit or receive a desired elliptically polarized RF signal, including a linearly polarized RF signal.

Referring to FIG. 1, the antenna 20 is preferably integrated with a window 22 of a vehicle 24. This window 22 may be a front window 22 (windshield), a rear window 22 (backlite), or any other window 22 of the vehicle 24. Those skilled in the art realize that the antenna 20 as described herein may be located at other positions on the vehicle 24, such as on a sheet metal portion like the roof of the vehicle 24 or on a side mirror of the vehicle 24. The antenna 20 may also be implemented in other situations completely separate from the vehicle 24, such as on a building or integrated with a radio receiver.

The window 22 includes at least one nonconductive pane 26. The term "nonconductive" refers to a material, such as an insulator or dielectric, that when placed between conductors at different potentials, permits only a small or negligible current in phase with the applied voltage to flow through material. Typically, nonconductive materials have conductivities on the order of nanosiemens/meter.

It is preferred that the at least one nonconductive pane 26 is implemented as a pane of glass. Of course, the window 22 may include more than one pane of glass. Automotive windows 22, particularly laminated glass commonly used in windshields, may include two panes of glass. The pane of glass is preferably automotive glass and more preferably soda-lime-silica glass. Preferably, each pane of glass defines a thickness between 1.5 and 5.0 mm, and most preferably 3.1 mm. The pane of glass also preferably has a relative permittivity between 5 and 9, and most preferably 7. Those skilled in the art, however, realize that the nonconductive pane 26 may be formed from plastic, fiberglass, or other suitable nonconductive materials.

Figure 2:
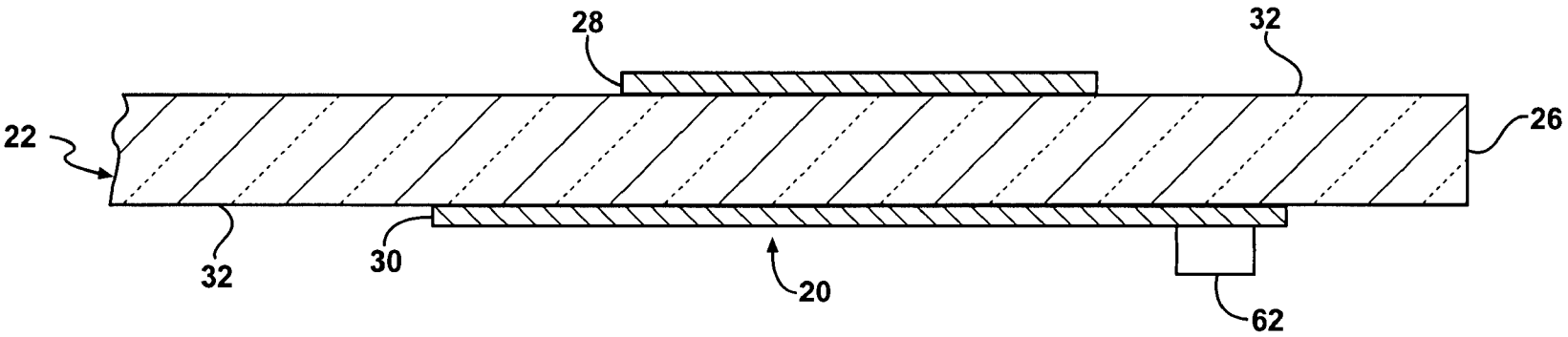
FIG. 2 is a partial cross-sectional view of a first embodiment of the antenna with a first conductive layer and a second conductive layer disposed on a pair of surfaces of a nonconductive pane.

Referring to FIG. 2, the antenna 20 includes a first conductive layer 28 and a second conductive layer 30. The second conductive layer 30 is spaced from and substantially parallel to the first conductive layer 28. The second conductive layer 30 also overlaps the first conductive layer 28. It is preferred that the at least one nonconductive pane 26 is used to maintain the spacing between the first and second conductive layers 28, 30. The nonconductive pane 26 acts as a dielectric. However, those skilled in the art realize alternative methods to maintain the spacing between the first and second conductive layers 28, 30. Those skilled in the art further understand that other substances, including air, may be implemented as the dielectric instead of the preferred nonconductive pane 26 of glass.

FIG. 2 shows a first embodiment of the invention where a single nonconductive pane 26 has a pair of surfaces 32. The first conductive layer 28 is disposed on one of the surfaces 32 and the second conductive layer 30 is disposed on the other of the surfaces 32. The conductive layers 28, 30 are substantially conformal with the nonconductive pane 26. Preferably, the conductive layers 28, 30 comprise a silver paste as the electrically conductive material that is disposed directly on the nonconductive pane 26 and hardened by a firing technique known to those skilled in the art. Alternatively, the conductive layers 28, 30 could comprise a flat piece of conductive metal, such as copper or aluminum, adhered to the nonconductive pane 26 using an adhesive. Those skilled in the art realize other ways of implementing the conductive layers 28, 30 with the nonconductive pane 26.

Figure 3:
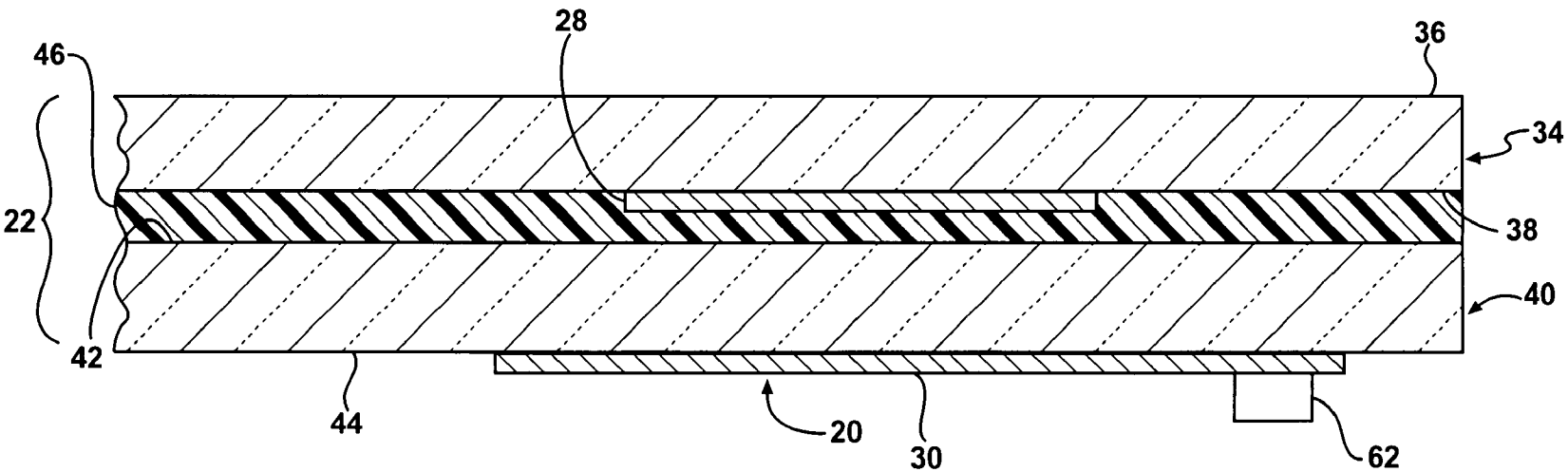
FIG. 3 is a partial cross-sectional view of a second embodiment of the antenna along the line 3—3 in FIGS. 10 and 11 with the first conductive layer disposed on an inner surface of a first nonconductive pane and the second conductive layer disposed on an inside surface of a second nonconductive pane.

Referring now to FIG. 3, the window 22, as mentioned above, may include two nonconductive panes. A first nonconductive pane 34 has an outside surface 36 and an inner surface 38. A second nonconductive pane 40 has an outer surface 42 and an inside surface 44. The second nonconductive pane 40 is disposed generally parallel to and spaced from the first nonconductive pane 34. The first conductive layer 28 is disposed on one of said surfaces 36, 38, 42, 44 and the second conductive layer 30 disposed on another of said surfaces 42, 44, 36, 38. As stated above, the second conductive layer 30 overlaps the first conductive layer 28 and the conductive layers 28, 30 are substantially conformal to the nonconductive panes 34, 40. An adhesive layer 46 is preferably sandwiched between the inner surface 38 of the first nonconductive pane 34 and the outer surface 42 of the second nonconductive pane 40. The adhesive layer 46 adheres the first nonconductive pane 34 to the second nonconductive pane 40. This adhesive layer 46 is preferably transparent and is typically formed from a polymer, such as polyvinyl butyral (PVB). However other suitable materials for implementing the adhesive layer 46 are known to those skilled in the art.

Figure 4:
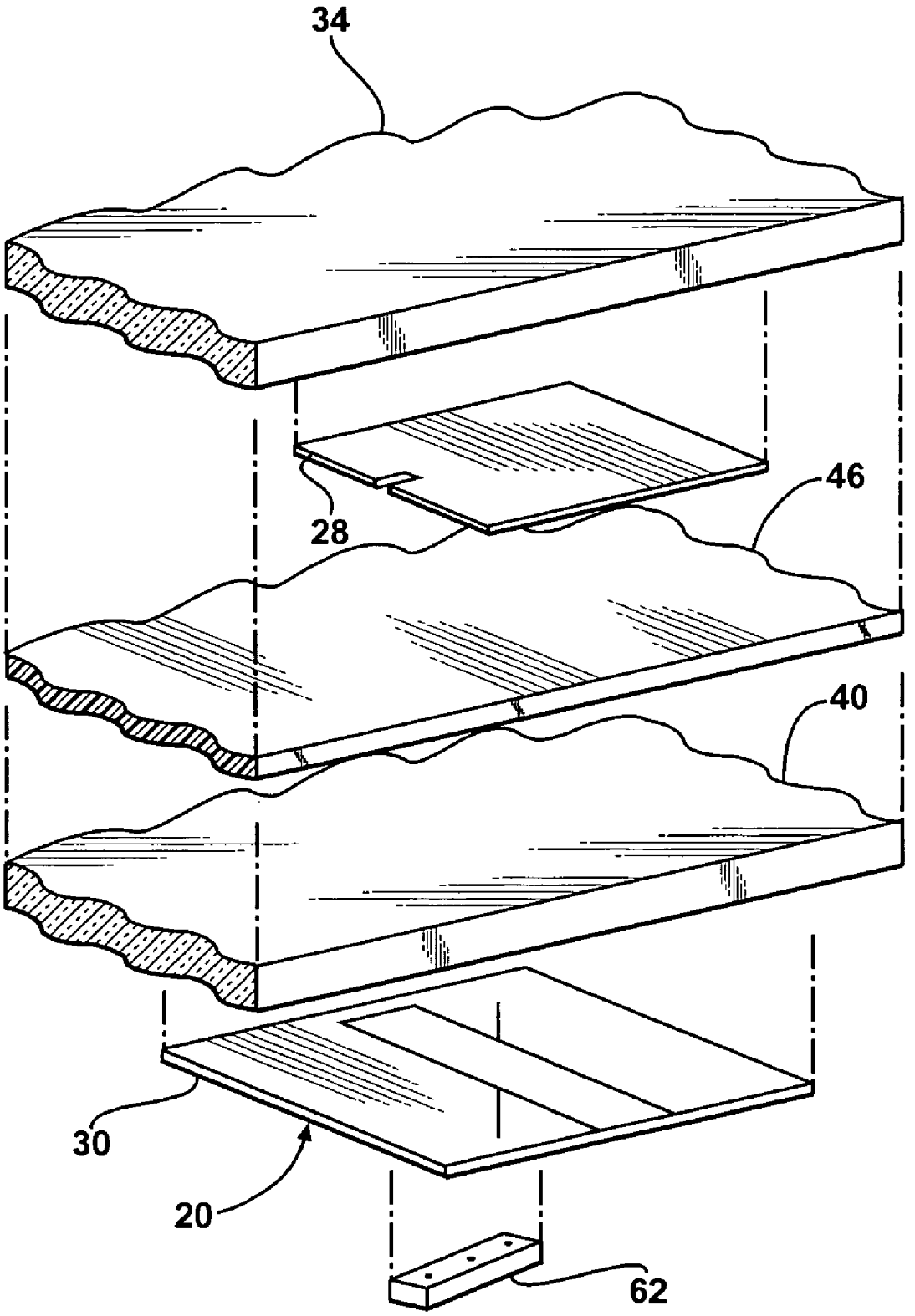
FIG. 4 is an exploded view of the second embodiment of the antenna.
Figure 5:
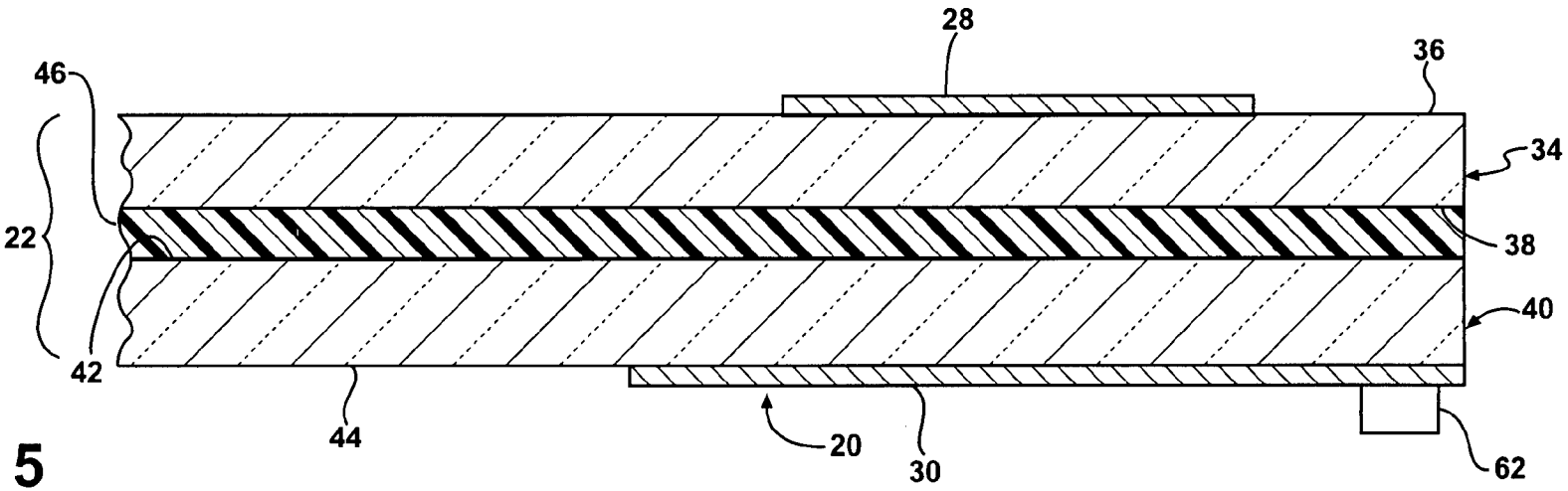
FIG. 5 is a partial cross-sectional view of a third embodiment of the antenna with the first conductive layer disposed on an outside surface of the first nonconductive pane and the second conductive layer disposed on the inside surface of the second nonconductive pane.
Figure 6:
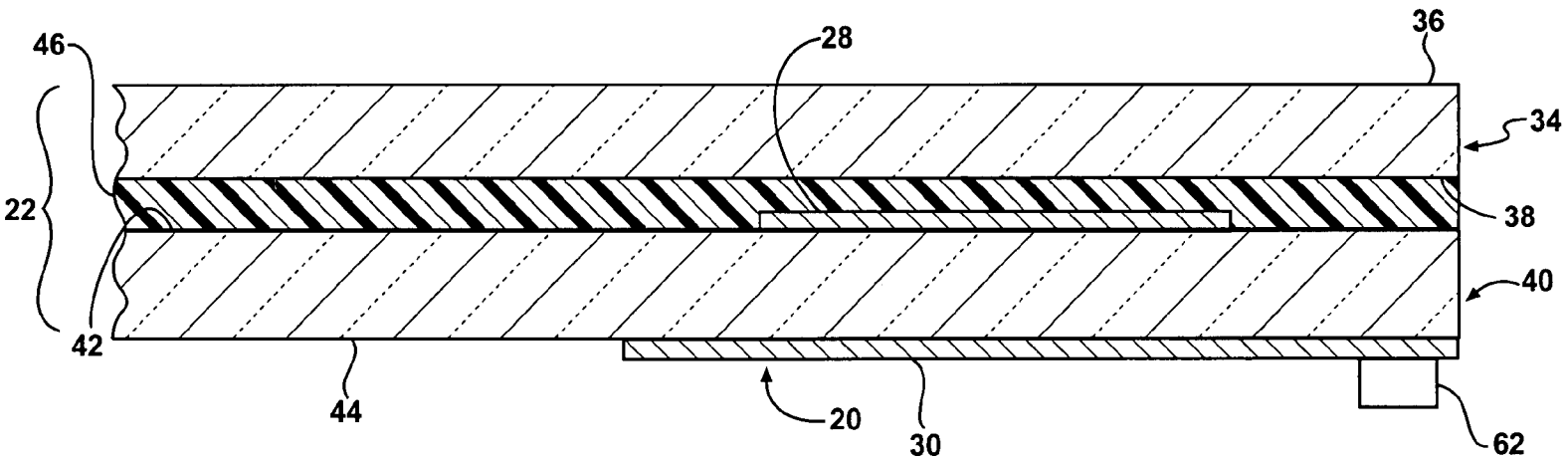
FIG. 6 is a partial cross-sectional view of a fourth embodiment of the antenna with the first conductive layer disposed on an outer surface of the second nonconductive pane and the second conductive layer disposed on the inside surface of the second nonconductive pane.
Figure 7:
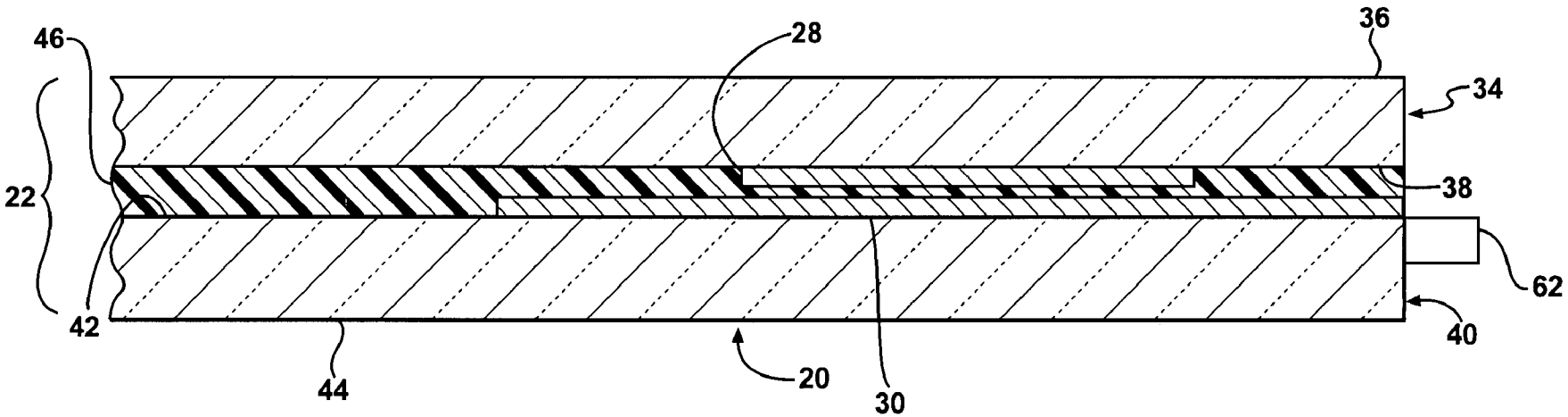
FIG. 7 is a partial cross-sectional view of a fifth embodiment of the antenna with the first conductive layer disposed on the inner surface of the first nonconductive pane and the second conductive layer disposed on the outer surface of the second nonconductive pane.
Figure 8:
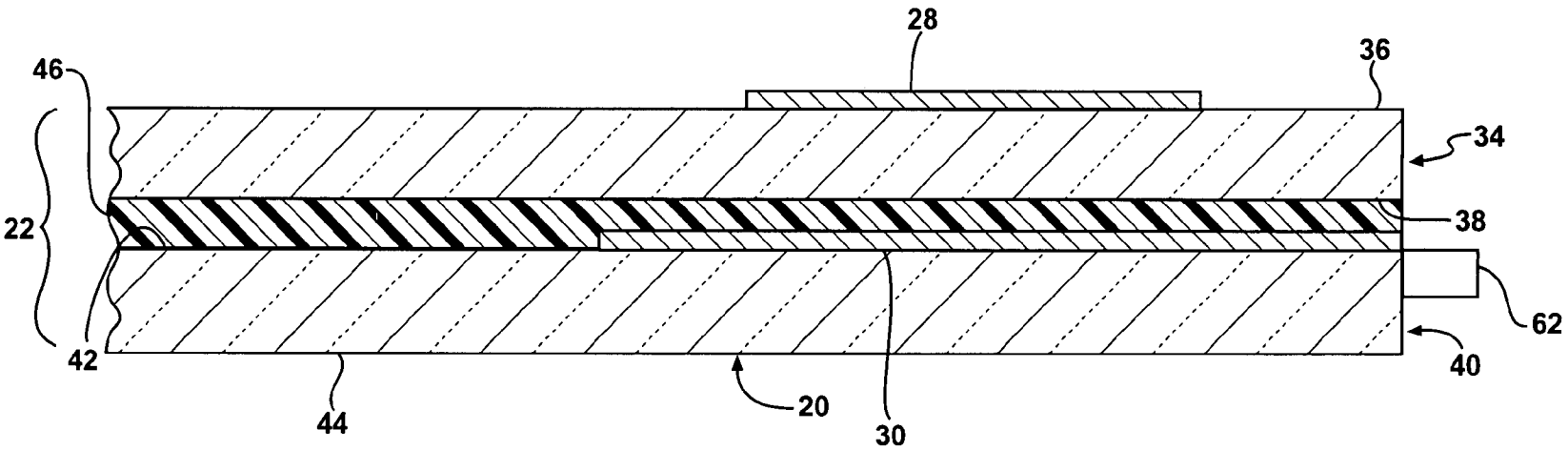
FIG. 8 is a partial cross-sectional view of a sixth embodiment of the antenna with the first conductive layer disposed on the outside surface of the first nonconductive pane and the second conductive layer disposed on the outer surface of the second nonconductive pane.
Figure 9:
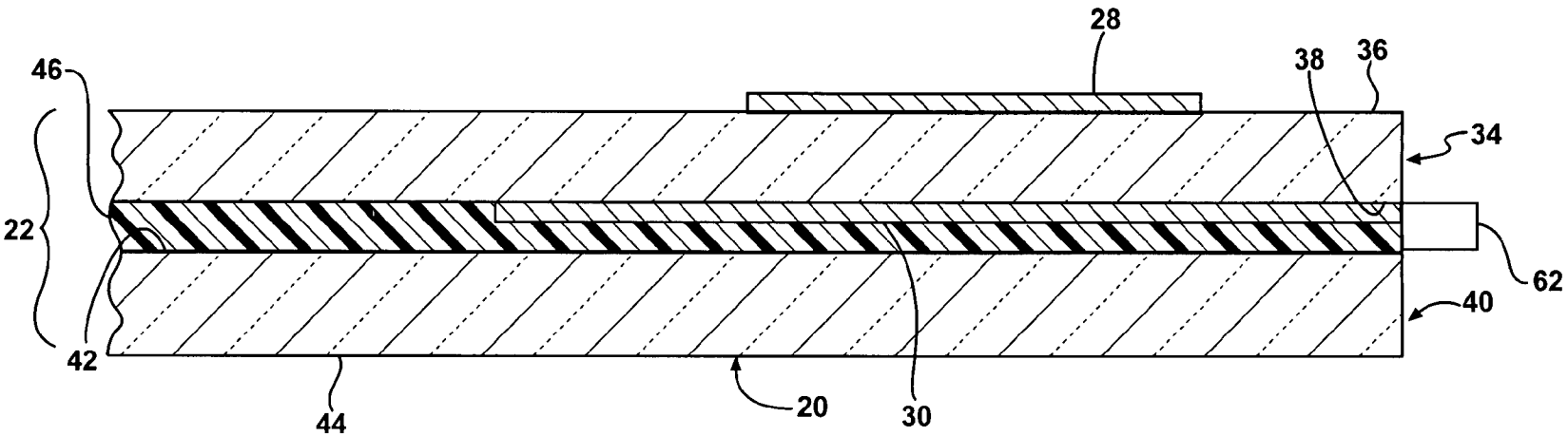
FIG. 9 is a partial cross-sectional view of a seventh embodiment of the antenna with the first conductive layer disposed on the outside surface of the first nonconductive pane and the second conductive layer disposed on the inner surface of the first nonconductive pane.

The first and second conductive layers 28, 30 can be arranged in several configurations with respect to the first and second nonconductive panes 34, 40. In a second embodiment, as shown in FIGS. 3 and 4, the first conductive layer 28 is disposed on the inner surface 38 and the second conductive layer 30 is disposed on the inside surface 44. Referring to FIG. 5, the first conductive layer 28 is disposed on the outside surface 36 and the second conductive layer 30 is disposed on the inside surface 44 in a third embodiment. Referring now to FIG. 6, a fourth embodiment has the first conductive layer 28 disposed on the outer surface 42 and the second conductive layer 30 disposed on the inside surface 44. In a fifth embodiment, as shown in FIG. 7, the first conductive layer 28 is disposed on the inner surface 38 and the second conductive layer 30 is disposed on the outer surface 42. The first conductive layer 28 is disposed on the outside surface 36 and the second conductive layer 30 is disposed on the outer surface 42 in a sixth embodiment shown in FIG. 8. And in a seventh embodiment, as shown in FIG. 9, the first conductive layer 28 is disposed on the outside surface 36 and the second conductive layer 30 is disposed on the inner surface 38.

Figure 10:
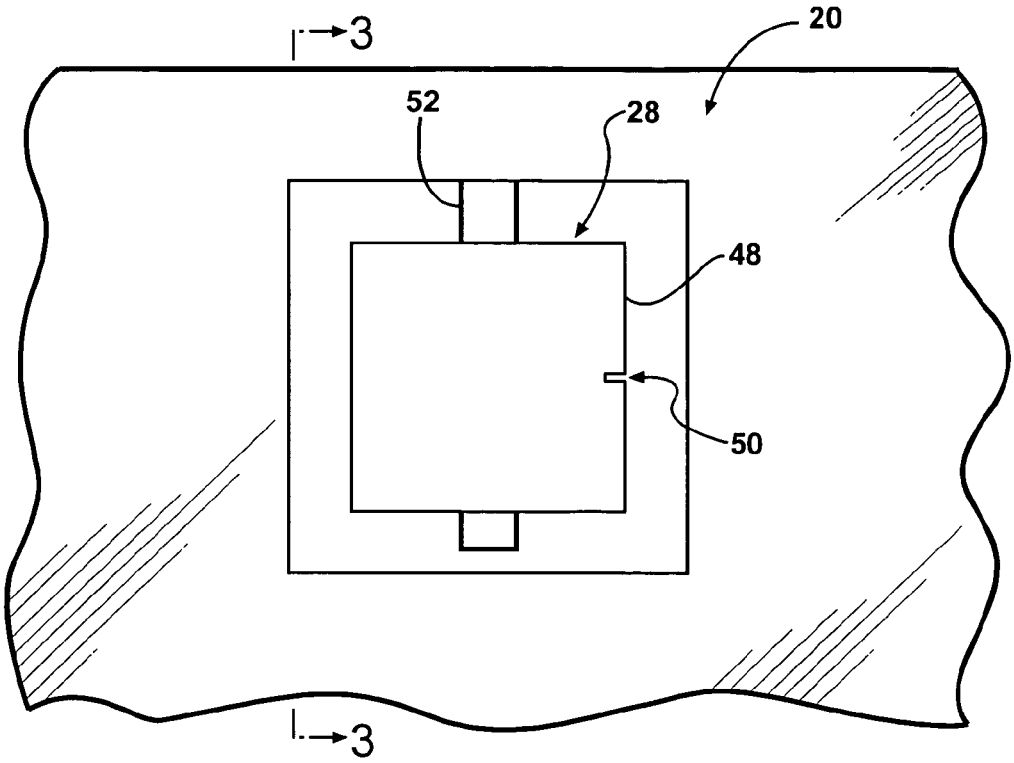
FIG. 10 is a top view of the antenna showing the first conductive layer, wherein the first conductive layer defines a notch extending inward from an edge.

Referring now to FIG. 10, the first conductive layer 28 acts as a radiation element of the antenna 20. The first conductive layer 28 is preferably rectangular-shaped and more preferably square-shaped. The lengths of the sides of the first conductive layer 28 are typically sized to match the desired frequency of the RF signal to be received and/or transmitted. In the case of SDARS applications, the lengths of the sides of the first conductive layer 28 are preferably between 25 mm and 35 mm. However, the first conductive layer 28 may be implemented using shapes other than rectangles or squares.

Figure 11:
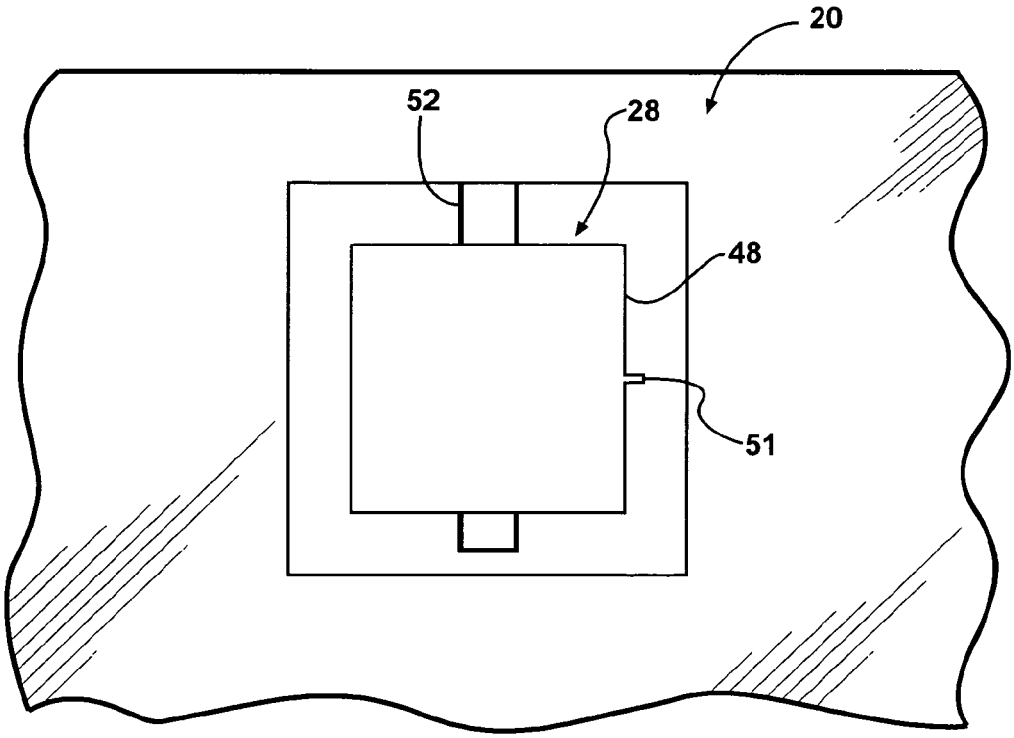
FIG. 11 is a top view of the antenna showing the first conductive layer, wherein the first conductive layer includes a projection extending outward from the edge.

The first conductive layer 28 includes an edge 48 having a midpoint. In the square-shaped first conductive layer 28, the edge 48 is one of the sides of the first conductive layer 28. The first conductive layer 28 preferably defines a notch 50 which extends inward from the edge 48. The notch 50 is preferably disposed at the midpoint of the edge 48. The notch 50 assists in tuning the antenna 20 to, a desired resonant frequency. By altering the length of the notch 50, the resonant frequency of the antenna 20 may be modified. Alternatively, and as shown in FIG. 11, a projection 51, extending outward from the edge 48, may be implemented for assisting in tuning the antenna to the desired resonant frequency. Moreover, multiple notches and/or projections may be disposed along the edge 48 or other sides of the first conductive layer 28 for modifying the frequency response and polarization characteristics of the antenna 10.

Figure 12:
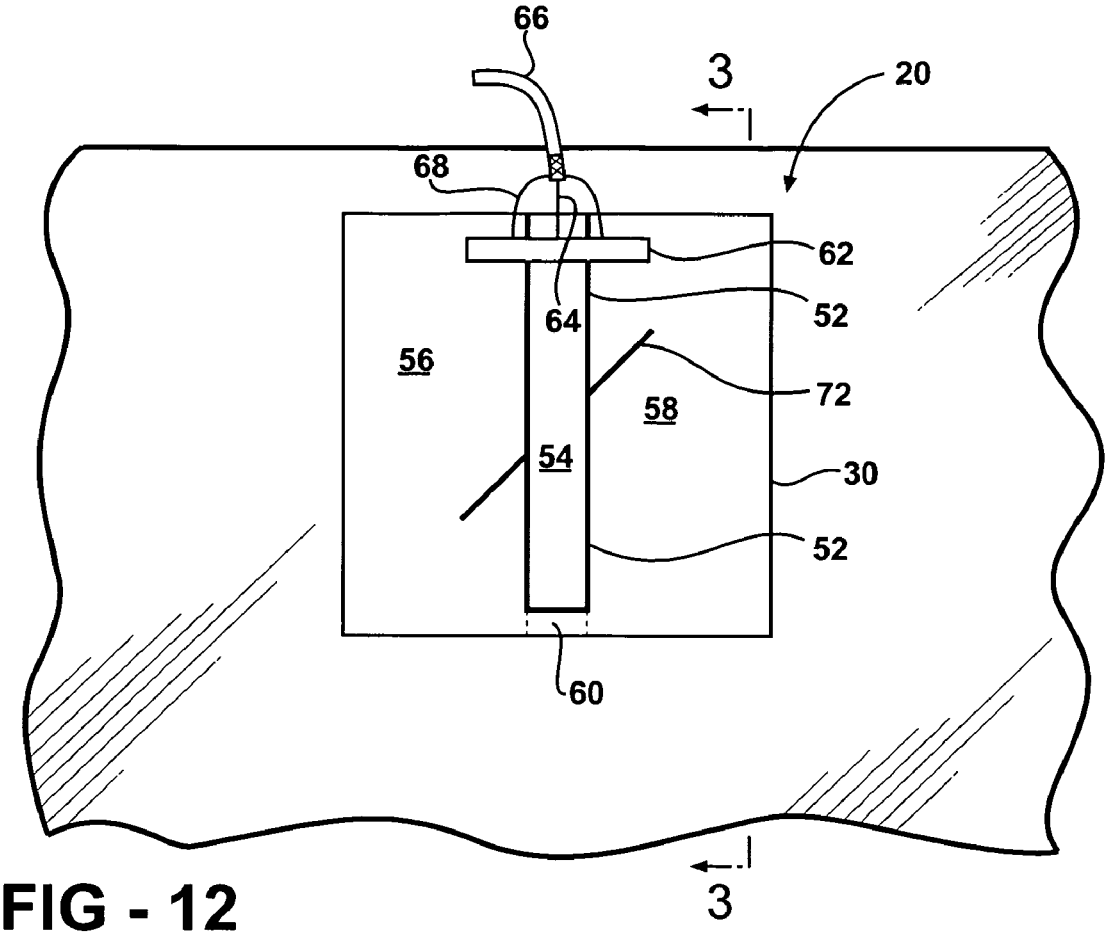
FIG. 12 is a bottom view of the antenna showing a main slot dividing the second conductive layer into a first ground plane region and a second ground plane region with a continuation of the second conductive layer electrically connecting the ground plane regions and a connector electrically connecting an unbalanced feed line to the second conductive layer.

Referring now to FIG. 12, the second conductive layer 30 of the antenna 20 has a main slot 52 extending thereinto. The main slot 52 defines a feed line region 54 and divides the second conductive layer 30 into a first ground plane region 56 and a second ground plane region 58. The feed line region 54 acts to transmit electromagnetic energy to the first conductive layer 28 or receive electromagnetic energy from the first conductive layer 28. The ground plane regions 56, 58 and the feed line region 54 act to electromagnetically couple RF signals to or from the first conductive layer 28.

Figure 13:
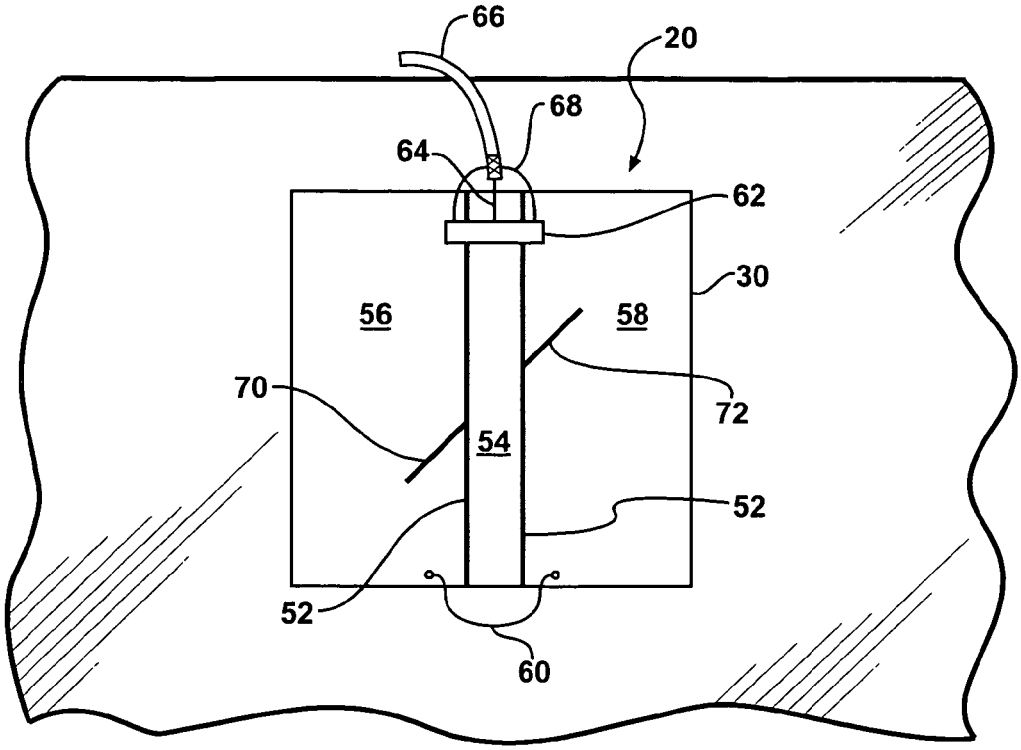
FIG. 13 is a bottom view of the antenna showing the main slot extending completely across the second conductive layer with a wire electrically connecting the ground plane regions and a connector electrically connecting the unbalanced feed line to the second conductive layer.

A conductive segment 60 electrically connects the first ground plane region 56 to the second ground plane region 58. As shown in FIG. 12, the conductive segment 60 is implemented as a continuation of the second conductive layer 30 and defined by the main slot 52. Alternatively, as shown in FIG. 13, the conductive segment 60 is implemented as a wire electrically connecting the first ground plane region 56 to the second ground plane region 58.

It is preferred that the second conductive layer 30 of the antenna 20 is rectangular-shaped and more preferably square-shaped. It is also preferred that the feed line region 54 is rectangular-shaped. However, the second conductive layer 30 and the feed line region 54 may be implemented using shapes other than rectangles or squares.

The second conductive layer 30 essentially combines two elements (a feed line and a ground plane) into a single layer conformal with the window 22. No additional feed line need be implemented with the antenna 10. This results in low complexity and implementation costs of the antenna 10.

Referring again to FIG. 10, the second conductive layer 30 preferably has an area larger than an area of the first conductive layer 28. This larger area allows for maximum reflection of the electromagnetic energy by the ground plane. Furthermore, the first and second conductive layers 28, 30 are preferably centered with respect to one another. It is also preferred that the feed line region 54 of the second conductive layer 30 extends across the first conductive layer 28. This positioning allows for optimal interaction between the radiation element of the first conductive layer 28, the feed line region 54, and the ground plane regions 56, 58.

Figure 14:
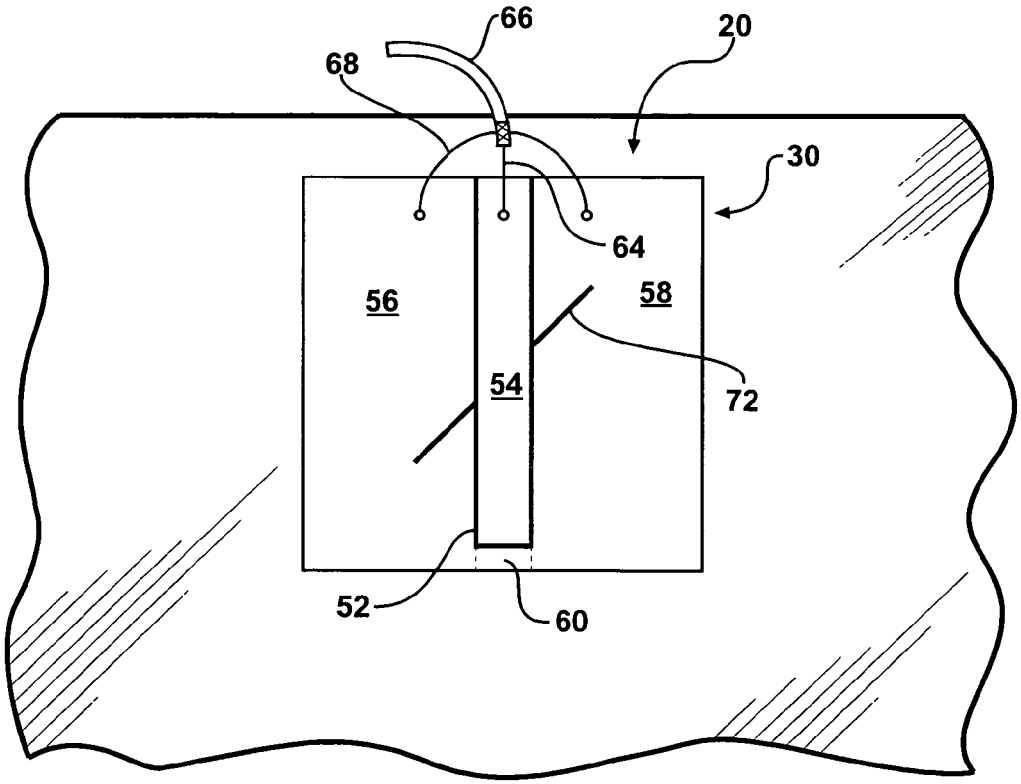
FIG. 14 is a bottom view of the antenna showing the unbalanced feed line soldered directly to the second conductive layer.

Referring again to FIG. 12, the antenna 20 preferably includes a connector 62 adjoining the second conductive layer 30. The connector 62 electrically connects the feed line region 54 to a center conductor 64 of an unbalanced transmission line 66. The connector 62 also electrically connects at least one of the ground plane regions 56, 58 to a shield 68 of the unbalanced transmission line 66. The positioning of the conductive layers 28, 30 and the connector 62 allow for an electrical connection of the antenna 20 to the unbalanced transmission line 66 without holes being disposed in the nonconductive panes 34, 40. As shown in FIG. 14, the antenna 20 may be implemented without the connector 62 by soldering the center conductor 64 and the shield 68 of the unbalanced transmission line 66 directly to the second conductive layer 30.

The second conductive layer 30 defines a first stub slot 70 extending from the main slot 52 into the first ground plane region 56 and a second stub slot 72 extending from the main slot 52 into the second ground plane region 58. The stub slots 70, 72 have an impact on the overall impedance of the antenna 20. Therefore, the lengths of the stub slots 70, 72 may be determined, based on the planned implementation of the antenna 20, to match the impedance of the antenna 20 to the impedance of the unbalanced transmission line 66. Additional impedance matching circuitry is not necessary since the impedance matching is incorporated directly in the second conductive layer 30 of the antenna 20. Thus, overall complexity of implementing the antenna 10 of the present invention is low. Additionally, more than two stub slots extending from the main slot 52 may be implemented.

The stub slots 70, 72 are disposed at an angle with respect to the main slot 52 to achieve a desired polarization of the antenna 20. In order to give the antenna 20 a circular polarization, the first stub slot 70 is disposed substantially at a 45 degree angle with the main slot 52, the second stub slot 72 is disposed substantially at a 45 degree angle with the main slot 52, and the first and second stub slots 70, 72 are generally parallel with each other. A linear polarization will result if the stub slots 70, 72 are disposed substantially at a 90 degree angle with the main slot 52. Furthermore, the stub slots 70, 72 may be disposed in multiple combinations and at various locations and angles with the main slot 52 to achieve any desired elliptical polarization.

Obviously, many modifications and variations of the present invention are possible in light of the above teachings. The invention may be practiced otherwise than as specifically described within the scope of the appended claims.

What is claimed is:

1. A window having an integrated antenna, said window comprising:

a first nonconductive pane having an outside surface and an inner surface;

a second nonconductive pane disposed generally parallel to and spaced from said first nonconductive pane and having an outer surface and an inside surface;

a first conductive layer disposed on one of said surfaces;

a second conductive layer disposed on another of said surfaces and overlapping said first conductive layer, said second conductive layer having a main slot extending thereinto to define a feed line region and dividing said second conductive layer into a first ground plane region and a second ground plane region; and a conductive segment electrically connecting said first ground plane region to said second ground plane region, said second conductive layer further having a first stub slot extending from said main slot into said first ground plane region and a second stub slot extending from said main slot into said second ground plane region.

2. A window as set forth in claim 1 wherein said first stub slot is disposed substantially at a 45 degree angle relative to said main slot, said second stub slot is disposed substantially at a 45 degree angle relative to said main slot, and said first and second stub slots are generally parallel with each other.

3. A window as set forth in claim 1 wherein said nonconductive panes are further defined as panes of glass.

4. A window as set forth in claim 3 wherein said panes of glass are further defined as automotive glass.

5. A window as set forth in claim 4 wherein said automotive glass is further defined as soda-lime-silica glass.

6. A window as set forth in claim 1 further comprising an adhesive layer sandwiched by said inner surface of said first nonconductive pane and said outer surface of said second nonconductive pane for adhering said first nonconductive pane to said second nonconductive pane.

7. A window as set forth in claim 6 wherein said first conductive layer is disposed on said inner surface and said second conductive layer is disposed on said inside surface.

8. A window as set forth in claim 6 wherein said first conductive layer is disposed on said outside surface and said second conductive layer is disposed on said inside surface.

9. A window as set forth in claim 6 wherein said first conductive layer is disposed on said outer surface and said second conductive layer is disposed on said inside surface.

10. A window as set forth in claim 6 wherein said first conductive layer is disposed on said inner surface and said second conductive layer is disposed on said outer surface.

11. A window as set forth in claim 6 wherein said first conductive layer is disposed on said outside surface and said second conductive layer is disposed on said outer surface.

12. A window as set forth in claim 6 wherein said first conductive layer is disposed on said outside surface and said second conductive layer is disposed on said inner surface.

13. A window as set forth in claim 1 wherein said first conductive layer includes an edge and said first conductive layer defines a notch extending inward from said edge.

14. A window as set forth in claim 13 wherein said edge defines a midpoint and said notch is disposed at said midpoint of said edge.

15. A window as set forth in claim 1 wherein said first conductive layer includes an edge and a projection extending outward from said edge.

16. A window as set forth in claim 1 wherein said feed line region of said second conductive layer extends across said first conductive layer.

17. A window as set forth in claim 1 wherein said conductive segment is further defined as a continuation of said second conductive layer defined by said main slot.

18. A window as set forth in claim 17 wherein said first conductive layer includes an edge and a projection extending outward from said edge.

19. A window as set forth in claim 1 wherein said conductive segment is further defined as a wire electrically connected to said first ground plane region and said second ground plane region.

20. A window as set forth in claim 1 further comprising a connector adjoining said second conductive layer for electrically connecting said feed line region to a center conductor of an unbalanced transmission line and electrically connecting at least one of said ground plane regions to a shield of the unbalanced transmission line.

21. A window as set forth in claim 1 wherein said first conductive layer is rectangularly-shaped.

22. A window as set forth in claim 21 wherein said second conductive layer is rectangularly-shaped.

23. A window as set forth in claim 22 wherein said first and second conductive layers are centered with respect to one another.

24. A window as set forth in claim 23 wherein said feed line region is rectangularly-shaped.

25. An antenna comprising:

a first conductive layer;

a second conductive layer spaced from and substantially parallel to and overlapping said first conductive layer;

said second conductive layer having a main slot extending thereinto to define a feed line region and dividing said second conductive layer into a first ground plane region and a second ground plane region;

a conductive segment electrically connecting said first ground plane region to said second ground plane region; and said second conductive layer defining a first stub slot extending from said main slot into said first ground plane region and a second stub slot extending from said main slot into said second ground plane region.

26. An antenna as set forth in claim 25 wherein said first stub slot is disposed substantially at a 45 degree angle with said main slot, said second stub slot is disposed substantially at a 45 degree angle with said main slot, and said first and second stub slots are generally parallel with each other.

27. An antenna as set forth in claim 25 further comprising a nonconductive pane having a pair of surfaces wherein said first conductive layer is disposed on one of said surfaces and said second conductive layer is disposed on the other of said surfaces.

28. An antenna as set forth in claim 25 wherein said first conductive layer includes an edge and said first conductive layer defines a notch extending inward from said edge.

29. An antenna as set forth in claim 28 wherein said edge defines a midpoint and said notch is disposed at said midpoint of said edge.

30. An antenna as set forth in claim 25 wherein said feed line region of said second conductive layer extends across said first conductive layer.

31. An antenna as set forth in claim 25 wherein said conductive segment is further defined as a continuation of said second conductive layer defined by said main slot.

32. An antenna as set forth in claim 25 wherein said conductive segment is further defined as a wire electrically connected to said first ground plane region and said second ground plane region.

33. An antenna as set forth in claim 25 further comprising a connector adjoining said second conductive layer for electrically connecting said feed line region to a center conductor of an unbalanced transmission line and electrically connecting at least one of said ground plane regions to a shield of the unbalanced transmission line.

34. An antenna as set forth in claim 25 wherein said first conductive layer is rectangularly-shaped.

35. An antenna as set forth in claim 34 wherein said second conductive layer is rectangularly-shaped.

36. An antenna as set forth in claim 35 wherein said first and second conductive layers are centered with respect to one another.

37. An antenna as set forth in claim 36 wherein said feed line region is rectangularly-shaped.

38. A window having an integrated antenna, said window comprising:

a first pane of glass having an outside surface and an inner surface;

a second pane of glass disposed generally parallel to and spaced from said first nonconductive pane and having an outer surface and an inside surface;

a first conductive layer disposed on one of said surfaces;

a second conductive layer disposed on another of said surfaces and overlapping said first conductive layer, said second conductive layer having a main slot extending thereinto to define a feed line region and dividing said second conductive layer into a first ground plane region and a second ground plane region, and a conductive segment electrically connecting said first ground plane region to said second ground plane region.

39. A window as set forth in claim 38 wherein said second conductive layer includes a first stub slot extending from said main slot into said first ground plane region and a second stub slot extending from said main slot into said second ground plane region.

40. A window as set forth in claim 38 wherein said first conductive layer includes an edge and said first conductive layer defines a notch extending inward from said edge.

41. A method of obtaining a desired polarization of an antenna having a first conductive layer, a second conductive layer space from and substantially parallel to and overlapping the first conductive layer, the second conductive layer defining a feed line region and dividing the second conductive layer into a first ground plane region and a second ground plane region, the second conductive layer further defining a slot extending from the main slot into the first ground plane region and a slot extending from the main slot into the second ground plane region, said method comprising the step of:

defining a first stub slot extending from the main slot into the first ground plane region at a first angle relative to the main slot and a second stub slot extending from the main slot into the second ground plane region at a second angle relative to the main slot.

42. A method as set forth in claim 41 wherein the angles are 45 degrees.

43. A method as set forth in claim 41 wherein the angles are 90 degrees.

* * * * *